US006269517B1

(12) United States Patent
Dornier

(10) Patent No.: US 6,269,517 B1
(45) Date of Patent: Aug. 7, 2001

(54) AUTOMATIC PANE CLEANING SYSTEM

(75) Inventor: Irén Dornier, Madrid (DE)

(73) Assignee: Dornier Technologie GmbH & Co., Munich (DE)

( * ) Notice: Subject to any disclaimer, the term of this patent is extended or adjusted under 35 U.S.C. 154(b) by 0 days.

(21) Appl. No.: 09/319,765

(22) PCT Filed: Dec. 13, 1997

(86) PCT No.: PCT/DE97/02826

§ 371 Date: Jul. 29, 1999

§ 102(e) Date: Jul. 29, 1999

(87) PCT Pub. No.: WO98/25506

PCT Pub. Date: Jun. 18, 1998

(30) Foreign Application Priority Data

Dec. 12, 1996 (DE) ..... 196 51 693

(51) Int. Cl.[7] ..... A47L 1/08
(52) U.S. Cl. ..... 15/322; 15/302; 15/322
(58) Field of Search ..... 15/302, 321, 322

(56) References Cited

U.S. PATENT DOCUMENTS 4,074,387 * 2/1978 Arato et al. ..... 15/322
4,586,208 * 5/1986 Trevarthen ..... 15/321
4,797,969 * 1/1989 Caduff ..... 15/302
4,800,607 * 1/1989 Fukutomi ..... 15/302
5,103,527 * 4/1992 Holland ..... 15/322
5,319,828 * 6/1994 Waldhauser et al. ..... 15/322
5,561,884 * 10/1996 Nijland et al. ..... 15/321
5,655,247 * 8/1997 Allen et al. ..... 15/302
5,867,861 * 2/1999 Kasen et al. ..... 15/322

* cited by examiner

*Primary Examiner*—Robert J. Warden, Sr.
*Assistant Examiner*—Theresa T. Snider
(74) *Attorney, Agent, or Firm*—Pyle & Piontek

(57) ABSTRACT

An automatic pane cleaning system includes a cleaning head containing at least one cleaning chamber, at least one suction chamber and at least one air supply chamber. Clean water, optionally mixed with cleaning additives, is supplied to the cleaning chamber to clean panes by means of ultrasound, rotating brushes or steam. Water is supplied through a closed air and water circuit which is connected to said chambers and by which the water loss is minimized during the supply of water.

6 Claims, 1 Drawing Sheet

AUTOMATIC PANE CLEANING SYSTEM

BACKGROUND OF THE INVENTION

The present invention relates to an automatic pane cleaning system. The invention is particularly suited for windows of a high building, such as a skyscraper, but can also be used for automatically cleaning facade surfaces, or the like.

Automatic pane cleaning systems have already been suggested for cleaning windows of high buildings, the systems comprising a gondola which is suspended from ropes and has secured thereto a cleaning head which is guided by a control means over the window surfaces. The gondola has mounted thereon the associated components of the cleaning system, such as water tank, power generator, drive means for the cleaning head, conduits, etc. The gondola is e.g. suspended from a crane which is movable on rails positioned on the roof of the building. The crane displaces the gondola from window to window to perform a corresponding cleaning operation on the windows.

Water is supplied from an associated water tank to the cleaning head by means of a pump and, after the cleaning process, the water is sucked off again from the cleaning head together with the dirt removed from the pane and together with the sucked-in air. The dirt water/air mixture is received in a separate dirty water container in the suggested systems and must be disposed off at a later time.

Such a pane cleaning system has the drawback that a large supply of clean water must be provided on the gondola and that the sucked-off dirty water also requires a large container, resulting in considerable dimensions and a great weight of the lift cage.

EP-A-642758 discloses an automatic cleaning system whose cleaning head is divided into a cleaning chamber and a suction chamber. Furthermore, the system comprises a clean water chamber from which water is supplied to the one cleaning chamber, as well as a dirty water chamber into which the dirt/air chamber is sucked.

Hence, such an automatic cleaning system is operated with a relatively large amount of water being consumed.

U.S. Pat. No. 3,775,804 describes an automatic pane cleaning system which comprises a single chamber from which only air is sucked off. The water flows from a collection region through a conduit into a water container which is arranged below the cleaning head and connected to said head for joint movement, and from which the water is again pumped off and supplied through a conduit to the spray nozzles. The water is not cleaned so that said cleaning system can only efficiently clean panes if it operates with a large amount of water in which the dirt particles received by reason of the cleaning process are virtually not noticeable.

SUMMARY OF THE INVENTION

It is the object of the present invention to provide an automatic pane cleaning system which operates without consuming a large amount of water.

According to the present invention, an automatic pane cleaning system is provided with a cleaning head, at least one cleaning chamber which is supplied with water from a clean water chamber, and at least one suction chamber from which the water is sucked off together with dirt particles and air into a dirty water chamber, the system being characterized in that the dirt water chamber is connected to the clean water chamber via a conduit which has arranged therein a pump and a filter means.

The amount of water needed for supplying the pane cleaning system with water is considerably reduced by the closed circuits consisting of the water which is needed for pane cleaning and has possibly admixed thereto cleaning additives, and of the air which is sucked in together with the soiled cleaning water during the suck-off operation; as a result, the production costs and the operating costs of the pane cleaning system according to the invention are reduced. Moreover, it is only thanks to such a system that a long-term operation becomes possible.

To be more specific, a water container is installed in the air and water circuit, said container containing the dirty water chamber and the chamber for clean water, hereinafter called clean water chamber. A joint container may here be divided by a partition which, however, does preferably not divide the interior into two chambers that are completely separated from one another, but only extends near the upper wall of the water container so that there remains an interconnected joint chamber above the two chambers for the air which is sucked off from the cleaning head together with the dirty water.

However, it is also within the scope of the invention that two separate containers can be arranged for receiving the dirty water and the clean water.

Furthermore, the suggestion is made that the at least one suction chamber of the cleaning head should be connected via a conduit, e.g. a hose, to the dirt water chamber of the water container. It should here be noted that the cleaning head may also comprise a plurality of separated suction chambers or a plurality of separated suction regions provided at the front side, which terminate in a joint rear suction chamber of the cleaning head.

The dirty water chamber of the water container is suitably connected to the clean water chamber via a conduit which has arranged therein a pump and a filter means in which the soiled water is cleaned before passing into the clear, water chamber.

Finally, the clean water chamber is connected to the at least one cleaning chamber of the cleaning head via a conduit provided with a pump; said cleaning head may also be provided with a plurality of separated cleaning chambers into which the pane wash water is introduced. In said at least one cleaning chamber or in said plurality of cleaning chambers, the dirt located on the panes is e.g. removed by ultrasound or mechanically by rotating brushes or by steam, with the dirt intermixing with the water or steam and being subsequently sucked off together with said water or steam.

When the cleaning head is operated by steam, a suitable steam generating means is arranged in the conduit leading to the cleaning chamber.

The air/water circuit is made complete in that the upper air chamber of the water container is connected via a conduit to the at least one air supply chamber of the cleaning head, said conduit being provided with a blower means which during operation of the pane cleaning system constantly sucks off air from the water container and feeds the air to the air supply chamber provided on the cleaning head. Such a closed air circuit prevents the loss of water which would otherwise be observed if the air sucked off together with the dirty wash water was discharged into the environment. The reason is that the air which is sucked off together with the dirty wash water is 100% saturated with water while fresh air which is sucked in from the environment would contain a considerably reduced amount of air moisture. Therefore, if the air sucked in together with the wash water was constantly discharged from the system and if fresh wair was sucked through the cleaning head into the water supply system, this would result in a constant and considerable loss of water which is avoided by the closed air circuit provided according to the invention.

According to a further suggestion of the invention, the at least one air supply chamber encloses the cleaning head. This air supply chamber as an outer annular channel can surround the cleaning head which may be followed radially inwards by a suction chamber, which is also annular. The invention, however, is not limited to such a design; rather, there may be provided suction regions distributed over the entire cleaning head.

It is important that air which is fed from the air supply chamber surrounding the cleaning head and, therefore, has a high content of air moisture, which is probably always within the range of saturation, is sucked into the suction chamber or chambers.

According to a further suggestion of the invention the at least one air supply chamber which surrounds the cleaning head is defined by an outer wall which consists at least in part of a thin-walled elastic material. The thin-walled elastic material makes it also possible to clean the edge portion of a pane, as the elastic outer wall of the air supply chamber can be deformed while the cleaning head is being guided towards the pane frame, in such a manner that it rests on the outer wall of the suction chamber of the cleaning head. Such a configuration does not impair the suck-off operation because an adequate amount of air is still sucked into the suction chamber from the other circumferential portions of the cleaning head.

Either the whole outer wall of the air supply chamber may consist of the thin-walled elastic material, or also only a wall strip having e.g. a depth of 30 mm, measured from the pane surface towards the back side of the cleaning head.

When the cleaning head leaves the area of the frame of the pane, the air supply chamber resumes its orginal shape due to the elastic material of its outer boundary wall.

The air/water circuit provided according to the invention makes it possible to feed the cleaning head of the automatic pane cleaning system having a small water reservoir with the water required for the cleaning process, and makes it possible to suck off and clean the dirty water again. Clean water is constantly supplied via hoses by means of a pump to the at least one cleaning chamber of the cleaning head, the cleaning effect being possibly enhanced in case of a considerable degree of pane soiling to be expected in that an electrically heated instantaneous water heater is installed between the pump and the at least one cleaning chamber to heat the water. When the cleaning head operates with steam, a suitable steam generating means is provided for.

In the at least one cleaning chamber the dirt is removed from the pane with the aid of water or steam, for instance by ultrasound.

Due to the action of a suction device, the water which has been mixed with dirt flows from the at least one cleaning chamber into the at least one suction chamber of the cleaning head and is supplied to the dirt water chamber of a two-chamber container via hoses with the aid of an air flow that is also sucked in. The air flow is generated by a blower which sucks off air from the two-chamber container and supplies it via a further hose to the at least one air supply chamber on the cleaning head. As already explained above in detail, such a closed air circuit prevents a continuous discharge of steam from the water supply circuit.

BRIEF DESCRIPTION OF THE DRAWINGS

The only FIGURE shows a section through a cleaning head and the water reservoir of an automatic pane cleaning system according to the invention in a purely schematic manner.

DETAILED DESCRIPTION

Figure 1:
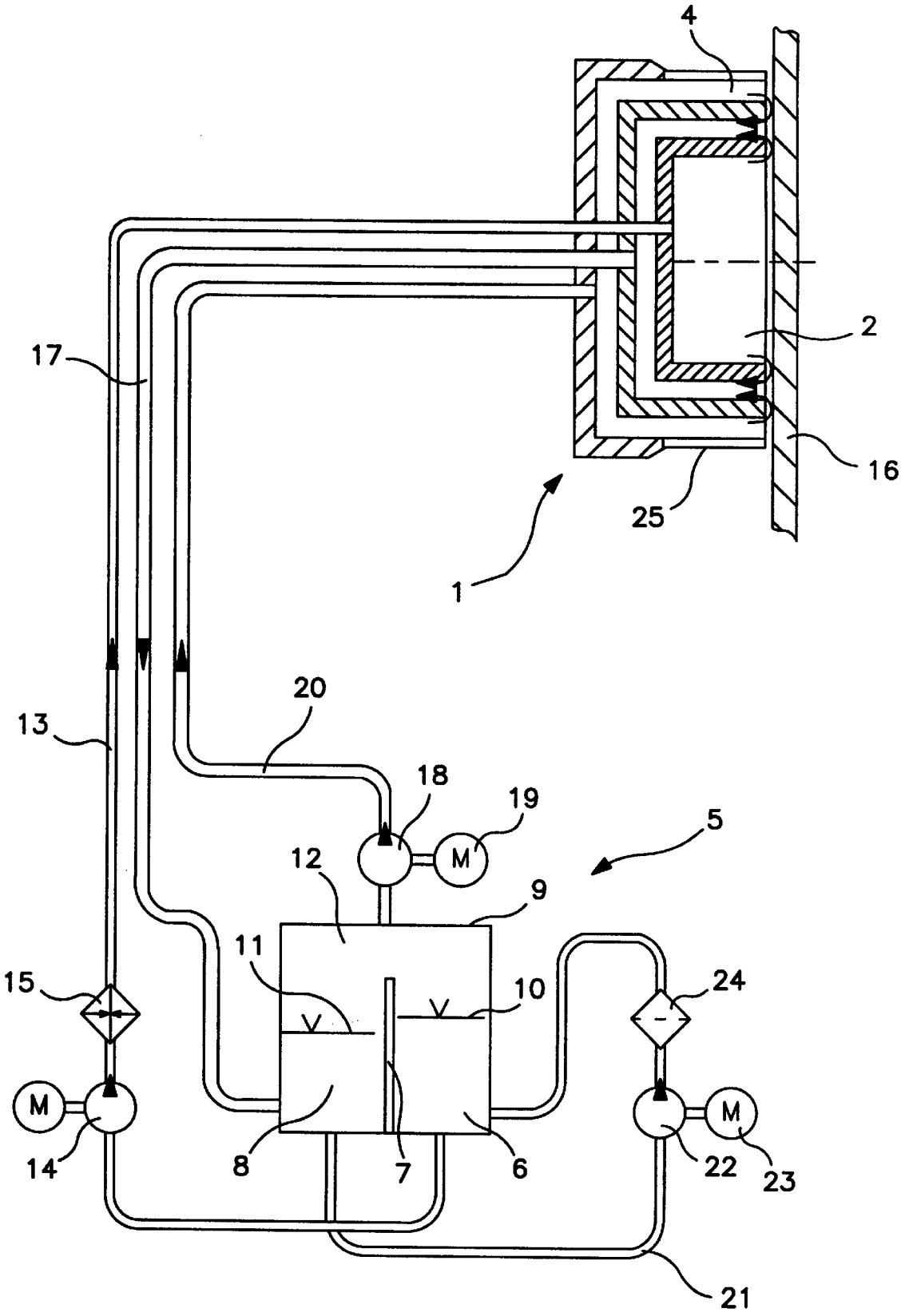

The cleaning head, which is designated by reference numeral 1 on the whole, contains a cleaning chamber 2, a suction chamber 3 which annularly surrounds the cleaning chamber 2, and an air supply chamber 4 which, in turn, annularly surrounds the cleaning chamber 3.

A two-chamber water tank 5 for the water supply device contains a chamber 6 for clean water, as well as a dirty water chamber 8 which is divided by a partition 7 within the water tank 5. The partition 7 ends below the upper end wall 9 of the water tank 5, whereby a joint air chamber 12 is created in the water tank above the water level 10 of the clean water and the water level 11 of the dirty water.

The clean water chamber 6 of the water tank 5 is connected via a conduit 13 to the cleaning chamber 2 of the cleaning head 1. A pump 14 pumps clean water through an instantaneous water heater 15 into the cleaning chamber 2 which cleans the surface of a pane 16 facing said chamber. The cleaning operation may e.g. be carried out by ultrasonic power which is transmitted by an ultrasonic generator arranged on the bottom of the cleaning chamber to the cleaning fluid with the effect that all dirt particles are rapidly and efficiently removed from the pane 16 by way of cavitation. When the instantaneous water heater is designed such that it converts the wash water passing therethrough into steam, the cleaning operation can e.g. also by carried out with the steam supplied under overpressure; to this end the cleaning chamber is suitably provided at its front side with a plurality of steam type cleaning chambers that are enclosed by webs, and the steam flows between the front edges of the webs and the pane surface into the suction chamber or a plurality of suction regions of a joint suction chamber. Such a steam flow will also clean the pane 16 in a reliable manner.

However, rotating brushes may e.g. also be arranged in the cleaning chamber for performing an efficient cleaning operation.

As has been mentioned, the wash water which has been mixed with the removed dirt particles is sucked into the suction chamber 3, namely together with air from the radially outer air supply chamber 4. The air/water/dirt mixture is conveyed through a conduit 17 into the dirty water chamber 8 of the water tank 5, which operation can be carried out with a pump, if necessary, the pump being not shown in the FIGURE. This suction operation, however, can also be accomplished by the action of a blower 18 which is arranged with its motor 19 in a conduit 20 that connects the air chamber 12 of the water tank 5 to the air supply chamber 4 of the cleaning head 1.

The dirty water chamber 8 communicates via a further conduit 21 with the clean water chamber 6 of the water tank 5, with a pump 22 being arranged in the conduit 21 together with an associated motor 23 and a filter circuit 24. In this filter circuit 24 the water is freed from the dirt absorbed during the cleaning operation.

While passing into the air chamber 12 of the water tank 5, the air which flows from the air supply chamber 5 into the suction chamber 3 is so intimately contacted with the water that it is 100% saturated with water. The air which is completely saturated with moisture is again supplied to the air supply chamber 4 according to the invention, whereby a closed water/air circuit is created in the case of which the loss of water is avoided, which would otherwise be observed if saturated air was constantly discharged to the environment and fresh air was sucked into the water supply system.

The air supply chamber 4 is defined by an outer wall 25 which consists of a thin-walled elastic material in the edge portion adjoining the pane 16.

What is claimed is:

1. An automatic pane cleaning system, said system comprising a cleaning head, said cleaning head comprising a cleaning chamber and a suction chamber; a clean water tank connected to the cleaning chamber, a dirty water tank connected to the suction chamber, and a pump and filter means connected between the dirty water tank and the clean water tank for pumping a filtering water from the dirty water tank into the clean water tank.

2. An automatic pane cleaning system, said system comprising a cleaning head, said cleaning head comprising a cleaning chamber and a suction chamber; a clean water tank connected to the cleaning chamber, a dirty water tank connected to the suction chamber, a conduit connected between the clean water tank and the cleaning chamber, pump means for pumping clean water to the cleaning chamber, and an instantaneous water heater in said conduit.

3. An automatic pane cleaning system, said system comprising a cleaning head, said cleaning head comprising a cleaning chamber, a suction chamber, and an air supply chamber, a clean water tank connected to the cleaning chamber, a dirty water tank connected to the suction chamber, an empty chamber above at least one of said clean and dirty water tanks, a conduit between the empty chamber and the air supply chamber, and a blower means in the conduit for blowing air into the air supply chamber.

4. The automatic pane cleaning system of claim 3 wherein said air supply chamber surrounds said cleaning chamber and the suction chamber.

5. The automatic pane cleaning system of claim 4 wherein said air supply chamber comprises an outer wall, said outer wall comprising an elastic material.

6. An automatic pane cleaning system, said system comprising a cleaning head, said cleaning head comprising a cleaning chamber, a suction chamber, and an air supply chamber; a source of clean water connected to the cleaning chamber, a dirty water tank connected to the suction chamber, means for supplying air under pressure to the air supply chamber, said air supply chamber surrounding said cleaning chamber and said suction chamber in said cleaning head.

* * * * *